United States Patent [19]

Kagoura

[11] 3,978,615

[45] Sept. 7, 1976

[54] SLIDING-OUT SASH WINDOWS HAVING PIVOTAL SUPPORTS

[75] Inventor: Tetsuro Kagoura, Kurobe, Japan

[73] Assignee: Yoshida Kogyo Kabushiki Kaisha, Japan

[22] Filed: Apr. 23, 1975

[21] Appl. No.: 570,741

[30] Foreign Application Priority Data

Apr. 26, 1974 Japan ..... 49-48462[U]

[52] U.S. Cl. ..... 49/251; 49/418; 267/177

[51] Int. Cl.[2] ..... E05D 15/44

[58] Field of Search ..... 49/250, 251, 252, 418, 49/197; 267/175, 177

[56] References Cited

UNITED STATES PATENTS

| | | | |
|---|---|---|---|
| 1,679,244 | 7/1928 | Fitzgerald | 49/418 X |
| 2,208,802 | 7/1940 | Montgomery | 49/251 |
| 2,323,585 | 7/1943 | Deuring | 49/197 |
| 2,674,452 | 4/1954 | Hummert | 49/251 X |

*Primary Examiner*—Kenneth Downey

*Attorney, Agent, or Firm*—Hill, Gross, Simpson, Van Santen, Steadman, Chiara & Simpson

[57] ABSTRACT

A window includes a sash movable between closed and open positions while pivoting on a pair of slides which are vertically movable along the respective side posts of an outer frame. For pivotally connecting the sash to each slide, a pair of axially aligned longitudinally spaced sleeves are mounted on the top edge of the sash, one of the sleeves slidably receiving a pivot pin projecting from the slide. Rotatably arranged between the sleeves is an adjustor ring having a key projecting into the interturn spacing of a helical compression spring mounted within the sleeves and secured at one end to the pivot pin. The contact force of the slide on the side post is adjustable by the rotation of the adjustor ring relatively to the sleeves.

8 Claims, 3 Drawing Figures

SLIDING-OUT SASH WINDOWS HAVING PIVOTAL SUPPORTS

BACKGROUND OF THE INVENTION

Field of the Invention

This invention relates generally to windows and in particular to sliding-out sash windows. More specifically, the invention deals with pivotal support means for the sash of a sliding-out window.

By the pivotal support means is meant the device for pivotally connecting the sash to each of a pair of slides which are slidable up and down along the respective side posts of a generally rectangular outer frame, in such a manner that the sash is pivotable between closed and open positions with the up-and-down movement of the slides.

Prior Art

Heretofore, for the adjustment of the force under which each slide is urged against the side post, a screw has been used which is inserted axially into one end of a sleeve or hollow cylinder which houses a spring and which is mounted on the window sash. The adjusting screw is turned in or out to vary the force of the spring urging the slide against the side post. This operation necessitates the use and manipulation of a tool such as a screw driver, which is troublesome where there is a lack of space. The use of the adjusting screw is also objectionable in that it is easily detached from the sleeve when loosened excessively or as a result of vibrations, such as those caused by the opening and closing of the window.

SUMMARY OF THE INVENTION

It is an object of this invention to provide an improved device for pivotally connecting the sash of a sliding-out window to each of a pair of slides movable along the respective side posts of an outer frame, such that the force of contact by the slides on the side posts is easily adjustable without use of any tool.

With this and other objects in view the invention provides a device including a pair of axially aligned, longitudinally spaced sleeves adapted to be fixedly mounted on a sash. One of the sleeves of each device receives a pivot pin projecting from each slide the slides being movable up and down along either side post of a generally rectangular outer frame. An adjustor ring is rotatably arranged between the sleeves, and a helical compression spring extends through the sleeves and the adjustor ring and is secured at one end to the pivot pin. The adjustor ring has an internal key projecting into the interturn spacing of the spring.

The contact force of the slide on the side post is adjustable merely by manually turning the adjustor ring relatively to the sleeves. Furthermore, since the helical compression spring extends through the adjustor ring sandwiched between the two sleeves, there is no possibility of the adjustor ring falling off the sleeves.

It is also noteworthy that the pivot pin projecting from each slide can be inserted into either of the two sleeves. Thus devices of exactly the same construction can be used for pivotal connection of the sash to the two slides. The devices can therefore be manufactured and maintained economically and there is no need to classify the devices as right-hand or left-hand devices.

The features which are believed to be novel and characteristic of this invention are set forth in particular in the appended claims. The invention itself, however, both as to its construction and manner of functioning, together with the further objects and advantages thereof, will become apparent from the following description of a typical embodiment which is to be read in connection with the accompanying drawings in which like reference characters denote like parts throughout.

DESCRIPTION OF THE PREFERRED EMBODIMENT

Figure 1:
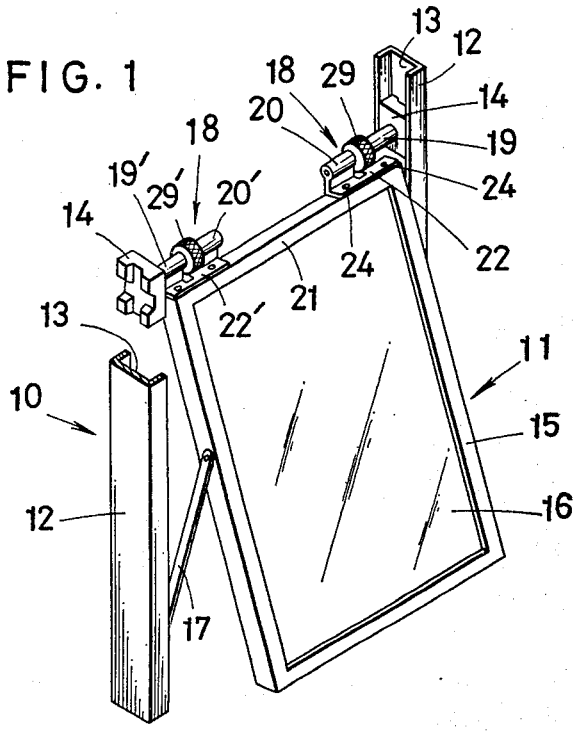
FIG. 1 is a partly broken-away perspective view of a sliding-out sash window incorporating the novel concepts of this invention.

FIG. 1 illustrates the general organization of the sliding-out sash window to which this invention is directed. The illustrated window comprises a generally rectangular outer frame 10 adapted to be set in an opening in a wall, and a sash 11 arranged for pivotally sliding in and out between closed and open positions in relation to the outer frame.

The outer frame 10 is broken away and only a pair of side posts 12 are shown to facilitate illustration, it being understood that the outer frame additionally comprises a header and sill connected to the side posts in the usual manner. The side posts 12 are each of U-shaped cross-section defining guideways 13 in opposed relationship. A pair of slides 14 are received in the respective guideways 13 for up-and-down sliding movement therealong.

The sash 11 includes a generally rectangular inner frame 15 extending along and embracing the periphery of a pane or panel of glass or other material 16. A pair of stay bars 17 are each pivotally connected at both ends to the side post 12 and the inner frame 15 to aid in the pivotal movement of the sash 11 between the closed and open positions.

The invention is specifically directed to the improved device 18 for pivotally connecting the sash 11 to each of the slides 14. Since two such devices needed for each sliding-out sash window of the above-described type can be of exactly the same construction, the description of one applies to both. The reference numerals used to refer to parts of one device 18 in the succeeding description are therefore simply primed in FIG. 1 to denote corresponding parts of the other device 18.

Figure 2:
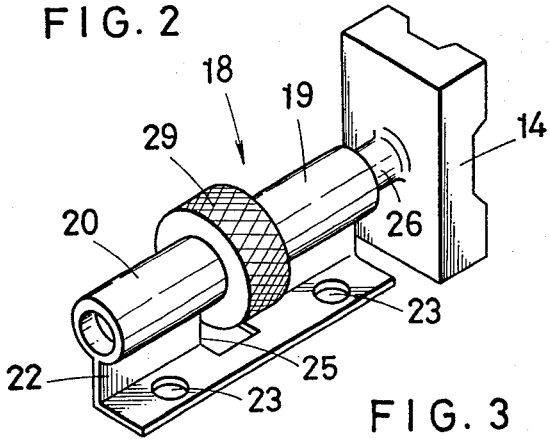
FIG. 2 is an enlarged perspective view of one of the devices of this invention shown in FIG. 1.
Figure 3:
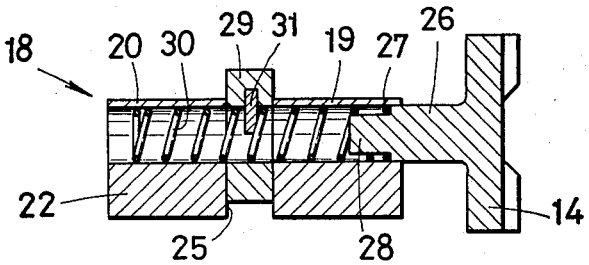
FIG. 3 is a vertical cross-sectional view of the device shown in FIG. 2.

As illustrated in greater detail in FIGS. 2 and 3, the device 18 includes a pair of axially aligned, longitudinally spaced sleeves 19 and 20 that are adapted to be rigidly mounted on the top horizontal member 21 of the inner frame 15 at or adjacent one end thereof. In this particular embodiment of the invention, the sleeves 19 and 20 are integral with an L-shaped mounting plate 22 having a pair of holes 23. The mounting plate 22 is secured to the top horizontal member 21 of the inner frame 15 by a pair of screws 24 or like fastener means driven through the holes 23, as illustrated in FIG. 1. The sleeves 19 and 20 thus mounted on the top horizontal member 21 extend in its longitudinal direction.

The mounting plate 22 is recessed at 25 in registration with the spacing between the sleeves 19 and 20.

The slide 14 has an integral pivot pin 26 projecting inwardly toward the inner frame 15. The pivot pin 26 is slidably received in the adjacent sleeve 19 and is movable in its longitudinal direction and so as to enable the pivotal movement of the sash 11 about the same. As shown in FIG. 3, the pivot pin 26 has a step 27 and terminates in a reduced diameter portion 28.

An adjustor ring 29 is rotatably arranged between the sleeves 19 and 20 in axial alignment therewith. The outer circumference of this adjustor ring 29 preferably is knurled to enable easy manual rotation thereof relative to the sleeves 19 and 20. The recess 25 in the mounting plate 22 accommodates the adjustor ring 29.

A helical compression spring 30 is disposed with clearance within and extends into the aligned sleeves 19 and 20 and the adjustor ring 29. The spring 30 is secured at one end to the pivot pin 26, in such a manner that the spring can bias the pivot pin 26 and therefore the slide 14 to the right, as shown in FIG. 3, but is incapable of rotation relative to the pivot pin. For thus connecting the spring 30 to the pivot pin 26, the spring is tightly wound around the reduced diameter portion 28 of the pivot pin or may be secured to a similar member which is square in cross-section.

The adjustor ring 29 has a key 31 projecting from its internal surface. The key 31 is received in the interturn spacing of the helical compression spring 30.

Thus, in the use of the above described device, the adjustor ring 29 may be manually turned relatively to the sleeves 19 and 20 in either direction to increase or decrease the number of turns of that portion of the helical compression spring 30 which is located between the key 31 and the pivot pin 26. An increase in the number of the spring turns increases the force by which the slide 14 is urged against the side post 12, whereas a decrease in the number decreases the force. The proper sliding movement of the slides 14 along the respective guideways 13 is realizable by the setting of the adjustor rings 29 and 29', thereby assuring a smooth pivotal movement of the sash 11 between the closed and open positions.

It is believed that the features and advantages of the improved device according to the invention are apparent from the foregoing detailed description. It is also understood, however, that while a preferred form of the device has been shown and described, changes may be made in the structure disclosed, without departing from the scope of the invention as defined in the following claims.

What is claimed is:

1. A window assembly comprising:

a. an outer frame having a pair of side posts with a pair of opposed elongated guideways therein, respectively;

b. a sash; and c. means mounting said sash in said frame for swinging movements between open and closed positions, said means including:

1. a pair of slides slidable in said guideways;
2. two pairs of axially aligned longitudinally spaced sleeves secured to said sash at opposite sides thereof adjacent said guideways;
3. two pivot pins respectively secured to said slides and each slidably projecting into one of said sleeves;
4. a pair of annular adjustor rings rotatably disposed in the spacing between said sleeves of each said pair of sleeves;
5. a pair of helical compression springs extending through said adjustor rings and into the adjacent ones of said sleeves urging said pivot pins toward said slides, respectively; and
6. a pair of keys respectively carried by said adjustor rings and projecting into the space between adjacent turns of the adjacent one of said springs;

whereby the compression with which the slides engage the guideways can be adjusted by rotation of the annular adjustor rings.

2. A window assembly according to claim 1 in which said adjustor rings project radially outwardly beyond said sleeves.

3. A window assembly according to claim 1 which includes a pair of mounting plates of L-shaped cross-section, each integral with one of said pairs of longitudinally spaced sleeves and secured to said sash.

4. A window assembly according to claim 3 in which said mounting plates are recessed at said adjustor ring.

5. A device for pivotally mounting a window sash in a frame adjacent to an elongated guideway, comprising:

a. a slide adapted to be moved in said guideway;

b. a pair of axially aligned longitudinally spaced sleeves adapted to be secured to the sash adjacent said guideway;

c. a pivot pin secured to said slide and slidably projecting into one of said sleeves;

d. an annular adjustor ring rotatably disposed in the spacing between said sleeves;

e. a helical compression spring extending through said adjustor ring and into said sleeves for urging the pivot pin toward said slide; and f. a key carried by said adjustor ring and projecting into the space between adjacent turns of said spring; whereby the compression with which the slide engages the guideway can be adjusted by rotation of the annular adjustor ring.

6. A device according to claim 5 in which said adjustor ring projects radially outwardly beyond said sleeves.

7. A device according to claim 5 which includes a mounting plate of L-shaped cross-section integral with said spaced sleeves and adapted to be secured to the sash.

8. A device according to claim 5 in which said mounting plate is recessed at said adjustor ring.

* * * * *